United States Patent [19]

Ohminato et al.

[11] Patent Number: 4,506,416

[45] Date of Patent: Mar. 26, 1985

[54] PAPER CLIP

[75] Inventors: Kiyoshi Ohminato, Chiba, Japan; Kenzo Miyamoto, deceased, late of Tokyo, Japan, by Toshiko Miyamoto, executor

[73] Assignee: King Jim Co., Ltd., Japan

[21] Appl. No.: 465,289

[22] Filed: Feb. 9, 1983

[51] Int. Cl.[3] ..... B42F 1/02

[52] U.S. Cl. ..... 24/67 R; 24/67.9; 24/67.7; 24/489; 24/545

[58] Field of Search ..... 24/67 R, 67.1, 67.3, 24/67.5, 67.7, 67.9, 67.11, 489, 545, 346

[56] References Cited

U.S. PATENT DOCUMENTS

| | | | |
|---|---|---|---|
| 3,131,449 | 5/1964 | Iida | 24/346 |
| 3,135,034 | 6/1964 | Fauteux | 24/489 |
| 3,349,453 | 10/1967 | Iida et al. | 24/489 |
| 3,404,435 | 10/1968 | Freundlich | 24/67.9 |
| 3,845,521 | 11/1974 | McNichol | 24/67.9 |
| 3,914,828 | 10/1975 | Noda | 24/489 |
| 4,084,299 | 4/1978 | Noda | 24/489 |
| 4,253,216 | 3/1981 | Brown | 24/67.7 |
| 4,277,863 | 7/1981 | Faneuf | 24/545 |

FOREIGN PATENT DOCUMENTS

| | | | |
|---|---|---|---|
| 242186 | 1/1961 | Australia | 24/545 |

*Primary Examiner*—Victor N. Sakran

*Attorney, Agent, or Firm*—Cantor and Lessler

[57] ABSTRACT

A paper clip characterized in that it is substantially formed of a hard synthetic resin such as hard vinyl chloride, and in that an arched movable member, a bottom plate and a connector plate are formed as one piece capable of being extruded in its entirety, and the paper-engaging end of said movable member and the central portion of said connector plate are formed of a soft synthetic resin such as soft vinyl chloride.

7 Claims, 4 Drawing Figures

PAPER CLIP

BACKGROUND OF THE INVENTION

The present invention relates to a paper clip, and more particularly to a clip which is formed as one piece capable of being extruded in its entirety.

This type of clip known in the art has a disadvantage that it is made of a metallic material in a time consuming and troublesome manner.

SUMMARY OF THE INVENTION

An object of the present invention is to eliminate the disadvantage of the prior art.

According to the present invention, this object is achieved by the provision of a paper clip characterized in that it is substantially formed of a hard synthetic resin such as hard vinyl chloride, an arched movable member, a bottom plate and a connector plate which are formed as one piece capable of being extruded in its entirety, and the paper-engaging end of the said movable member and the center portion of said connector plate are formed of a soft synthetic resin such as soft vinyl chloride.

BRIEF DESCRIPTION OF THE DRAWINGS

The present invention will now be explained with reference to the accompanying drawings, in which.

PREFERRED EMBODIMENT OF THE INVENTION

Figure 1:
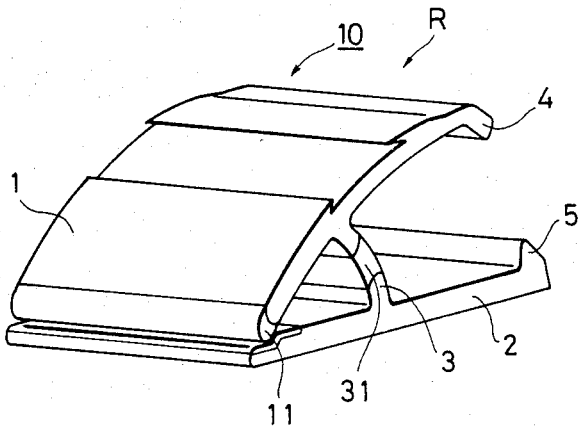
FIG. 1 is a perspective view of the clip according to the present invention.
Figure 2A:
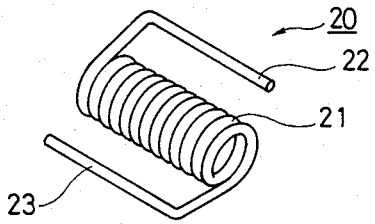
FIGS. 2*a* and 2*b* are views showing a helical spring and a leaf spring member used in the present invention.
Figure 2B:
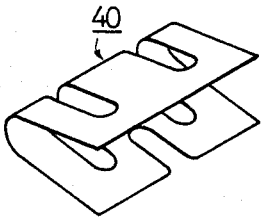

Referring to the drawings, in particular FIG. 1, a clip 10 according to the present invention includes an arched movable member 1, a bottom plate 2 and a connector plate 3 for connecting both with each other. The movable member 1 is provided at its rear end with a spring-receiving portion 4, and the bottom plate 2 is also provided at its rear portion with a lug 5 serving as a spring-receiving portion. Between the movable member and the bottom plate, there is such a spring member as shown at 20 in FIG. 2.

Figure 3:
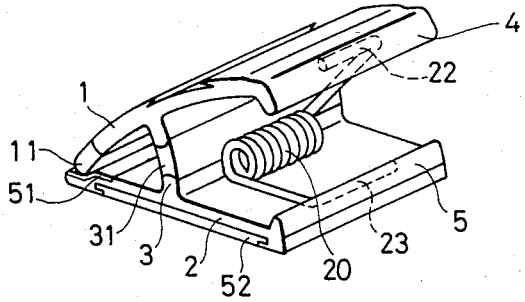
FIG. 3 is a view from the direction of R in FIG. 1.

The spring member 20 includes a portion 22 coming in contact with the movable member and a portion 23 coming in contact with the bottom plate. As shown in FIG. 3, the clip 10 is combined with the spring member 20. That is the portions 22 and 23 of the spring 20 engage the spring-receiving portion 4 of the member 1 and the lug 5 of the plate 2, respectively. The movable member 1 of the clip 10 is constantly biased counterclockwise under the action of the spring 20 with its end being brought into engagement with the bottom plate 2 for holding paper sheets. It is understood that a leaf spring 40 may be used in the present invention.

Thus, the clip according to the present invention can be made by extrusion in one piece, and cut to the desired length in a very simple manner.

To give the overall clip the required strength, it is substantially formed of a hard synthetic resin such as hard vinyl chloride. However, the paper-engaging end 11 of the member 1 and the central portion 31 of the plate 3 are formed of a soft synthetic resin such as soft vinyl chloride so as to softly hold papers in place and make the movement of the member 1 smooth. In this case, better results are obtained if the end of the bottom plate 2 brought into engagement with the end 11 of the movable member 1 is also formed of a soft synthetic resin.

In use, a downward push is given to the rear end of the movable member 1 against the action of the spring 20, whereby the movable member is turned clockwise to space the end 11 away from the bottom plate 2 for attachment or detachment of paper. The release of that downward push causes counterclockwise turning of the movable member 1 under the action of the spring 20, so that the end 11 engages with the bottom plate 2, as shown in FIG. 1, for holding paper in place.

For convenience, the bottom plate 2 is notched at 52 into which a magnet plate is fitted in order to attach the clip to a wall or blackboard of metal.

With the arrangement as described above, it is possible to make the clip by extrusion since it is substantially formed of synthetic resin in its entirety. In addition, since the end of the movable member and the central portion of the connector plate are formed of a soft synthetic resin, it is possible to surely hold paper in place and allow smooth turning of the movable member.

What is claimed is:

1. A paper clip comprising a unitary flat bottom member having a paper engaging end and a handle end, a convexly arcuate movable top member having a paper-engaging end and a handle end, and an arcuate web joining the top and bottom members intermediate their ends, said top and bottom members being normally biased such that said paper-engaging ends are in contact with each other, said paper-engaging end of said top member and the central portion of said web being formed of a soft synthetic resin, the remainder of said paper clip being formed of a hard synthetic resin.

2. A paper clip as claimed in claim 1, wherein said soft synthetic resin is soft polyvinyl chloride, said hard synthetic resin is hard polyvinyl chloride, and said paper clip is formed by extrusion.

3. A paper clip as claimed in claim 1, wherein said members are biased by means of a coil spring operation disposed between said top and bottom members at the handle ends thereof.

4. A paper clip as claimed in claim 1, wherein said members are biased by means of a leaf spring operatively disposed between said top and bottom members at the handle ends thereof.

5. A paper clip as claimed in claim 1, wherein the paper-engaging end of said bottom member is formed of a soft synthetic resin.

6. A paper clip as claimed in claim 4, wherein said soft synthetic resin is soft polyvinyl chloride, said hard synthetic resin is hard polyvinyl chloride, and said paper clip is formed by extrusion.

7. A paper clip as claimed in claim 1, further comprising a magnet embedded in said bottom member.

* * * * *